US005772249A

United States Patent [19]

Guex et al.

[11] Patent Number: 5,772,249

[45] Date of Patent: Jun. 30, 1998

[54] METHOD OF GENERATING A SECURITY DESIGN WITH THE AID OF ELECTRONIC MEANS

[75] Inventors: Lan Guex, Belmont; Laurent Mathys, Plan-les-Ouates, both of Switzerland

[73] Assignee: De La Rue Giori S.A., Switzerland

[21] Appl. No.: 534,663

[22] Filed: Sep. 27, 1995

[30] Foreign Application Priority Data

Nov. 1, 1994 [CH] Switzerland ..... 3264/94

[51] Int. Cl.[6] ..... B42B 15/00; B41D 3/14

[52] U.S. Cl. ..... 283/93; 427/7; 427/286; 427/288; 427/385.5

[58] Field of Search ..... 427/7, 286, 288, 427/385.5; 283/72

[56] References Cited

U.S. PATENT DOCUMENTS 1,002,600 9/1911 Morris et al. ..... 427/7
1,390,959 9/1921 Longmesser ..... 427/7
1,506,144 8/1924 Weeks ..... 427/7

FOREIGN PATENT DOCUMENTS 360256 4/1987 Germany .
1138011 12/1968 United Kingdom .

*Primary Examiner*—Janyce Bell
*Attorney, Agent, or Firm*—Kane, Dalsimer, Sullivan, Kurucz, Levy, Eisele and Richard, LLP

[57] ABSTRACT

A net of parallel lines is generated with the aid of a computer. The ratio of the width to the spacing of two consecutive lines is equal to $r_o$. The spacing and width of the lines are successively modulated such that their ratio is equal to $r_o$. Subsequently, the straight lines can if so chosen be transformed into differently shaped lines or the width of the strokes can be altered in order to reproduce geometrical or artistic images.

10 Claims, 8 Drawing Sheets

METHOD OF GENERATING A SECURITY DESIGN WITH THE AID OF ELECTRONIC MEANS

FIELD OF THE INVENTION

The present invention relates to a method for generating, with the aid of electronic means, a security design intended to be printed on paper securities, especially banknotes and currency papers, and composed of multiple lines, as well as to a printing plate and to a paper security bearing at least one design generated by implementing the method.

PRIOR ART

For the purpose of making it difficult, or even impossible, to reproduce paper securities, especially banknotes, currency papers, shares, postage stamps, etc., one tries to build in security elements. Thus, it has been proposed to resort separately or in combination to various means, namely: the use of a special watermarked paper, the incorporation into the paper of a metal or other security element, the creation of designs which are extremely expensive to counterfeit, making the expected gain from such counterfeiting a chance affair, the use of colors and of color shades which are difficult to reproduce, etc.

Technological progress in relation to photocopiers and scanners is such that several of these means are no longer adequate to thwart the malevolent intentions of counterfeiters. Since the appearance of high-performance color photocopiers, the manufacturers of such paper securities have concentrated on creating zones forming moiré fringes during digital copying, for example with a color photocopier, of a document. These moiré fringes distort the original image and provide an indication that this is a copy.

The moiré fringes appear when lines which are or are not parallel, spaced apart by a distance of the magnitude of the sampling point, lie in perpendicular alignment to one of the sampling axes of the machine. The reading of the information is disturbed and the original image is distorted and, in particular, nonuniform modifications of the hues and colors are found. The appearance of such moiré fringes is difficult to forecast since it depends on the characteristics and settings of the apparatus used for reproduction.

In EP-A-0,204,552, a security design is described comprising areas formed by non-parallel strokes, whose width and/or distancing vary.

In EP-A-0,353,974, security zones on paper securities are described comprising areas formed by parallel strokes, certain parts of which are distorted as regards the width and/or the shape of the stroke in order to form images, hidden or otherwise.

SUMMARY OF THE INVENTION

The choosing of particular security designs makes it possible to bring about the appearance of moiré fringes. The purpose of the present invention is to propose a method making it possible to generate designs forming moiré fringes during digital copying thereof. The invention therefore proposes a method of generating designs which is based on multiple lines.

The method according to the invention is such that the following steps are carried out:

a) a uniform background is generated, consisting of parallel straight lines such that the distance between the longitudinal mid-axes of two consecutive lines, designated as the spacing do between two lines, is constant and such that the width $l_0$ of the line strokes is also constant, thus determining a constant ratio $r_0=l_0/d_0$, b) the background is modified by modulating the spacing $d_0$ between the lines according to a modulation function whose parameters are chosen beforehand, c) the width of the line strokes is modified such that the ratio of the width $l_n$ of the stroke of a line to its spacing $d_n$ with the following line is equal to the constant ratio $l_n/d_n=r_o$.

The advantages of the method according to the invention are, on the one hand, that the modifications of the distribution of the lines may be parametrized with respect to the photocopiers or scanners against which it is desired to be protected and, on the other hand, that these modifications do not distort the original visual look, to the naked eye, of the image by virtue of the fact that the ratio of the stroke width of a line to the spacing between two consecutive lines remains constant.

Paper securities which are to be manufactured subsequently and incorporating such designs may be furnished with several security designs corresponding to different parameters so that, for a document, several machines of different types may be protected against.

An important advantage of the invention is the fact that it allows the creation of security designs comprising geometrical or artistic images, whereas hitherto the security designs of this type have not comprised geometrical or artistic images.

Various alternatives in respect of the creation of designs are proposed, thus it is possible to restrict attention to transforming the straight lines to lines of some other shape, for example sinusoids, concentric circles, closed or open curved lines, etc., in each situation the width of the stroke of each line remaining equal to the value obtained in step c of the method.

According to another alternative embodiment, the lines of the background may be turned by an angle $\alpha$ partially or totally or merely the segments of the lines lying inside an outline delimiting an image may be turned through this angle.

According to another alternative embodiment and for the purpose of forming an image, the said lines are cut, hence broken inside the outline delimiting the image.

According to another alternative embodiment and still for the purpose of forming an image on top of the background created by the said lines, the lines are modulated by the shape (outline) of an image and a relief effect is created by known means, especially by breaking the continuity of the lines.

According to another alternative embodiment, for the purpose of creating a geometrical image, the width of the strokes is modified as a function of the gray level of the original geometrical image.

Finally, according to one alternative, the line segments which do not contribute to the formation of an image retain their width and spacing complying with the ratio $r_0$ defined in step c of the method.

According to another alternative embodiment and for the purpose of creating an artistic image, the width of the strokes is modified as a function of the original digital image obtained with a scanner.

The present invention also relates to a printing plate furnished with at least one design generated as claimed in one of claims 1 to 8 and intended for the printing of a paper security.

The invention also relates to a paper security comprising at least one security design generated as claimed in one of claims 1 to 8.

BRIEF DESCRIPTION OF THE DRAWINGS

The invention will be described in greater detail with the aid of the appended drawing showing various alternative embodiments.

The method will now be described with the aid of the appended drawings.

The pairs of drawings 8, 9; 10, 11; 12, 13; 14, 15; and 16, 17 represent the modification of the first drawing of the pair to the second according to other alternative embodiments of the invention.

DESCRIPTION OF THE PREFERRED EMBODIMENTS

Figure 2:
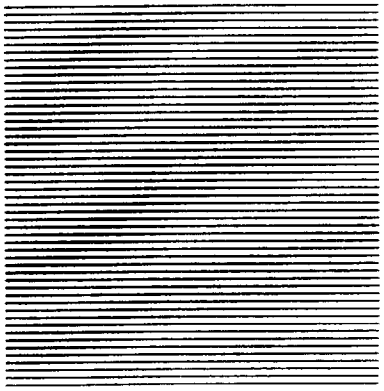
FIGS. 2, 3 and 4 represent a modification of a regular net of lines according to an alternative of the invention.

In FIG. 2, we have represented a set of parallel straight lines, the spacing between two consecutive lines is constant and equal to $d_o$, the width of the stroke along the whole of a line is equal to $l_0$ and the ratio $r_0=l_0/d_0$ is constant.

Figure 3:
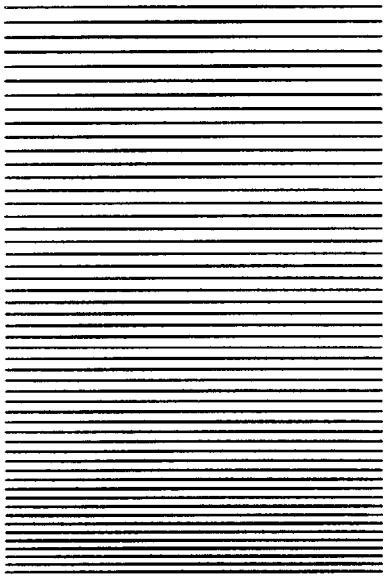

The spacing between two lines is subsequently modulated such that the gap between two consecutive lines $t_{n+1}$ is equal to $d_n=d_0+(n.\delta.)$, $\delta$ being a parameter for the linear modulation of the spacing. By applying this rule, we obtain a net of lines according to FIG. 3.

Figure 1:
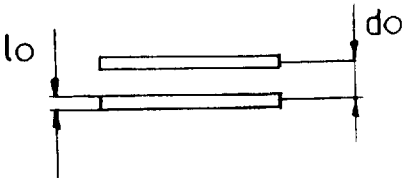
In FIG. 1, we have shown, magnified, two strokes whose width is $l_0$ and for which the distance between the longitudinal mid-axes is equal to $d_0$.

Subsequently, in order to comply with the condition that the ratio of the width of a stroke to the spacing of a line to the following line be equal to the value of the constant ratio $r_0$, the width $l_n$ of the strokes is modified such that $l_n=l_0+(n.\lambda)$ such that the ratio $l_n/d_n$ is always equal to $r_0$, $\lambda$ being a parameter for modulating the stroke width. In that case we obtain a net of lines having the shape of FIG. 4, whose visual look (to the naked eye) for widths and spacings which are less than those represented in the appended drawings is similar to that of FIG. 1.

Figure 4:
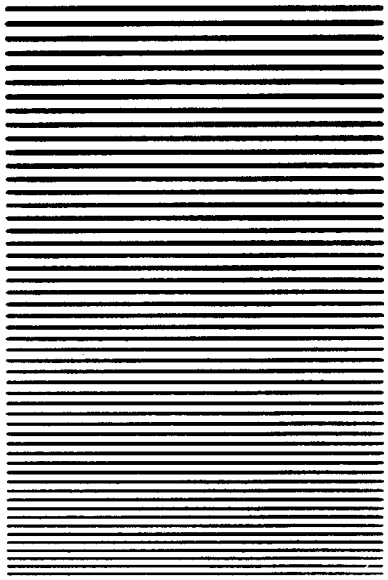

With a background such as that of FIG. 4, certain copiers or scanners will be unable to eliminate the moiré effect. It is obvious that the parameters such as $l_0$ as well as $\delta$ and $\lambda$ may be modified depending on the characteristics of the machines. The benefit is that the diversity in the spacing between the lines and the widths of the strokes endow the image with a uniform look to the naked eye, but it is impossible to avoid the formation of moiré fringes during reproduction even by modifying the characteristics of the reproduction machine over a range of values. The parameters for modulating the spacing and width are chosen with respect to the reproduction machine(s) which it is wished to combat.

Figure 7:
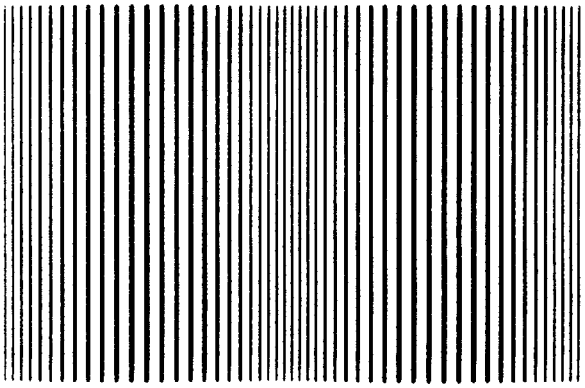
FIGS. 5, 6 and 7 represent a modification of a net of lines according to another alternative embodiment of the invention.
Figure 6:
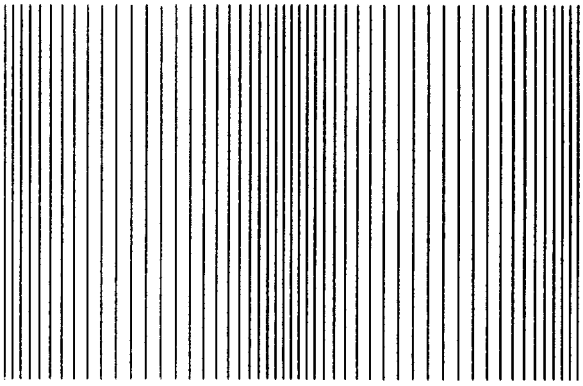
Figure 5:
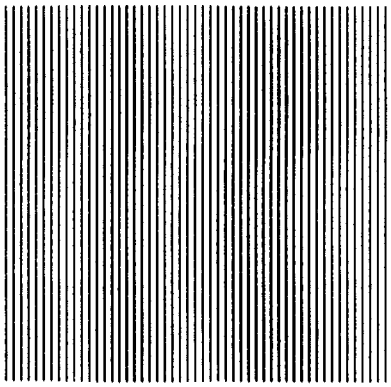

Another alternative modulation is shown in FIGS. 5 to 7, FIG. 5 being identical to FIG. 2. In FIG. 6 the spacing is modulated according to the following rule $d_n=d_0+\delta\,(1+\sin(2\pi\, n/N))$. In this present case N is the modulation period. We thus obtain a background in which the spacing between two consecutive lines does not vary linearly as in FIG. 2, but sinusoidally. Again in order to comply with the condition of the constant ratio between the stroke width and the spacing, the stroke width is also modified and this is done according to the following rule: $l_n=l_0+\lambda\times(1+\sin 2\rho\, n/N)$. In that case we obtain FIG. 7.

Figure 9:
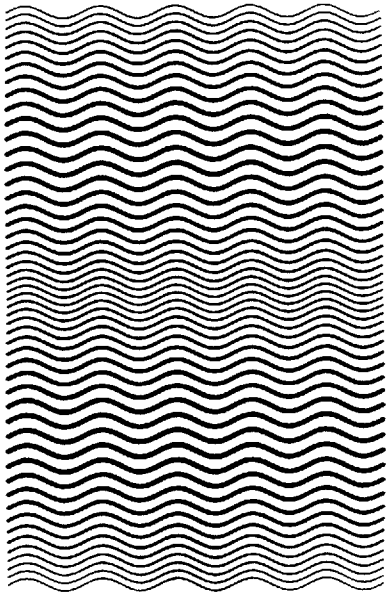
Figure 8:
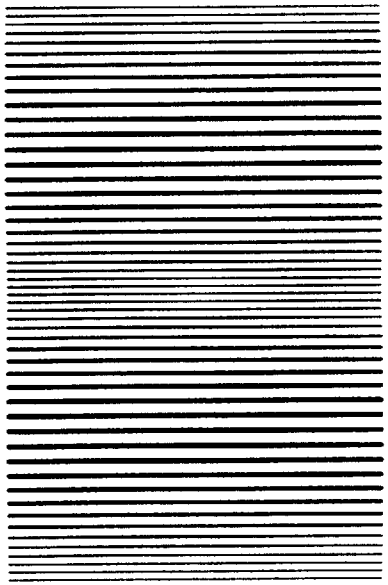
Figure 11:
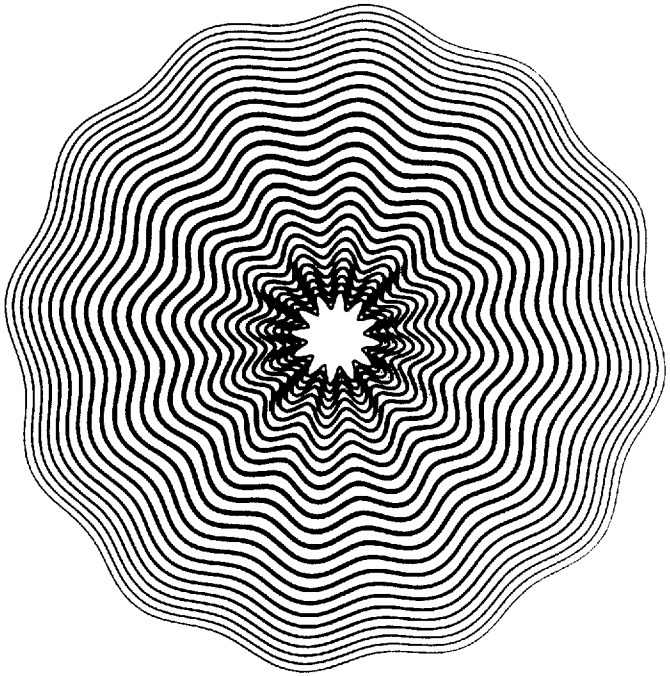
Figure 10:
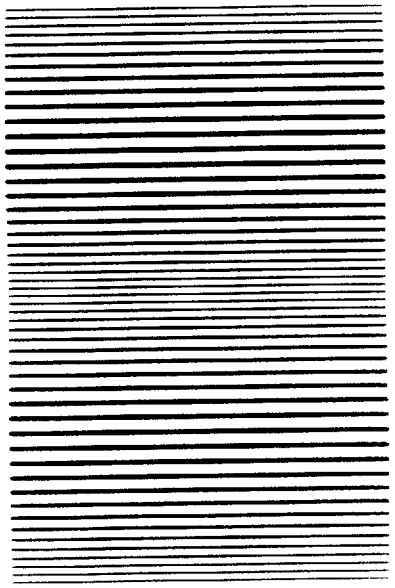
Figure 13:
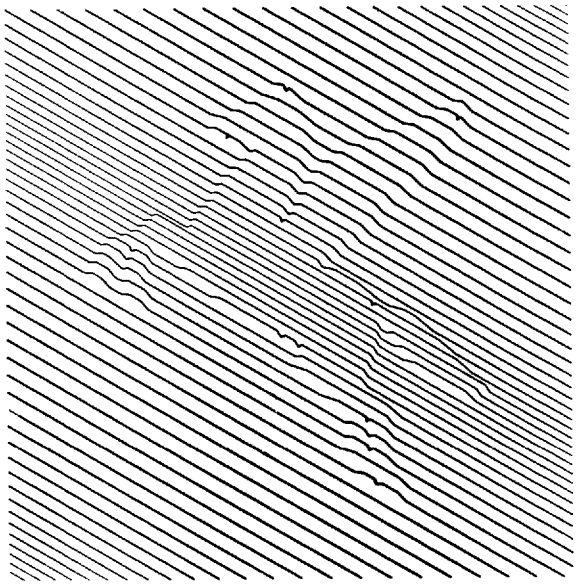

Another modification step after having obtained FIG. 7 is to modify the shape of the lines while complying with the width of the strokes obtained for example in FIG. 4 or 7. Thus, starting from FIG. 8 which is identical to FIG. 7, we can obtain FIG. 9 which is formed of lines forming waves or sinusoids. Likewise, referring to FIGS. 10 and 11 where FIG. 10 is identical to FIG. 7, these lines can be transformed into concentric closed curves whilst complying with the width of the strokes of FIG. 10. The form of this transformation of the straight lines into closed curves is not restricted and it depends on the desired result.

Figure 12:
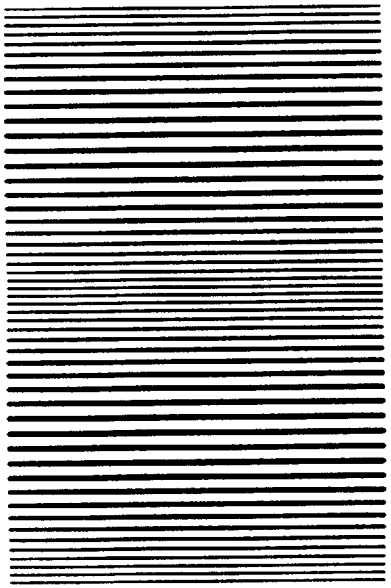
Figure 15:
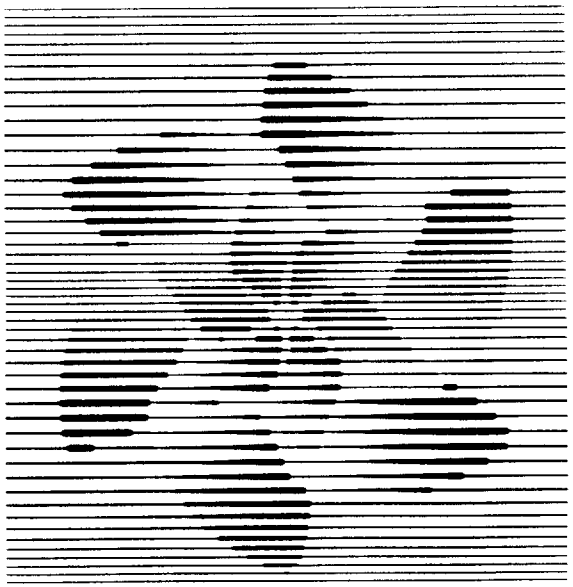

Another embodiment, again starting from a FIG. 12 which is identical to FIG. 7, is to turn the lines by an angle of for example 45° and subsequently to create the outline of an image (in the present case a winged horse) by creating a relief or medal effect by breaking the straight lines.

Figure 14:
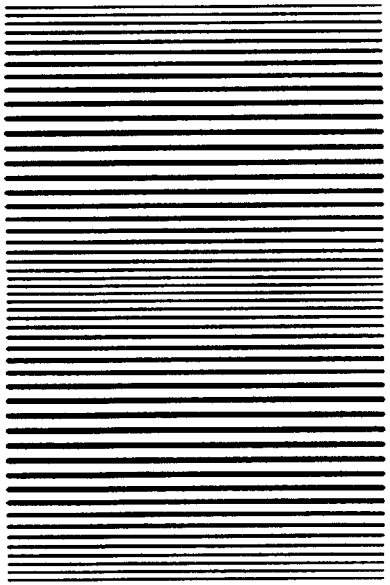
Figure 17:
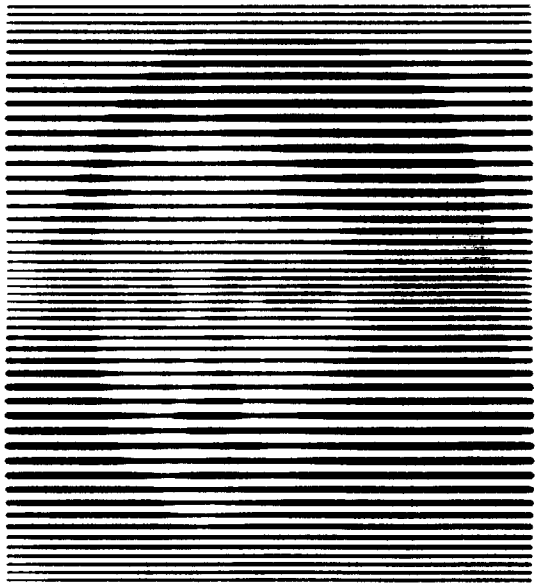

Starting again from a figure such as that of FIG. 7 represented here in the guise of FIG. 14, we can modify the width of the strokes as a function of the gray level of the original geometrical image.

Figure 16:
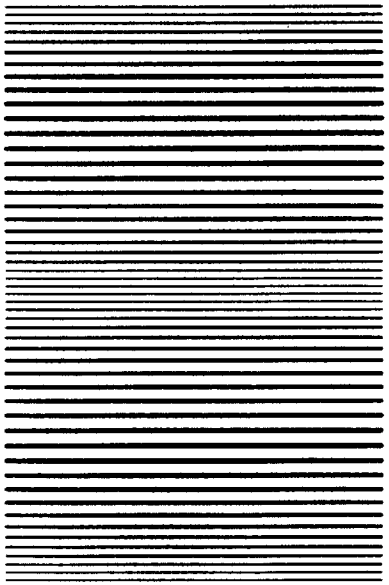

Finally, another way of proceeding and of creating an artistic image is, starting from a net of lines according to FIG. 16 which is identical to that of FIG. 7, the width of the lines is modified on the basis of the artistic image which has previously been digitized via a scanner.

The ratio $r_0$ could be retained for the segments of the lines which do not contribute to the formation of the image.

The invention also relates to a printing plate furnished with at least one security design created according to one of the methods described as well as to a paper security furnished with at least one such design.

These security designs can be printed by any technical process, for example offset, intaglio, etc.

It is obvious that various embodiments have been proposed relating to the generation of a design, but it is equally possible, within a design, to use several of these possibilities, for example merely a part of an image could be turned by 45° or a complex design created exhibiting several of the abovementioned possibilities.

We claim:

1. A method for generating, with the aid of electronic means, a security design intended to be printed on paper securities, especially banknotes and currency papers, and composed of multiple lines, wherein the following steps are carried out:

a) a uniform background is generated, consisting of parallel straight lines such that the distance between the longitudinal mid-axes of two consecutive lines, designated as the spacing do between two lines, is constant and such that the width $l_0$ of the line strokes is also constant, thus determining a constant ratio $r_0=l_0/d_0$, b) the background is modified by modulating the spacing $d_0$ between the lines according to a nonprogressive modulation function whose parameters are chosen beforehand, c) the width of the line strokes is modified such that the ratio of the width $l_n$ of the stroke of a line to its spacing $d_n$ with the following line is equal to the constant ratio $l_n/d_n=r_0$.

2. The method as claimed in claim 1, wherein said straight lines are transformed into lines of a different shape, the width of the stroke of each line being equal to the width obtained in step c of claim 1.

3. The method as claimed in claim 1, wherein at least some of said lines are subjected to a rotation by an angle.

4. The method as claimed in claim 1, wherein, for the purpose of forming an image, said lines are cut inside the outlines delimiting said image.

5. The method as claimed in claim 4, wherein the line segments which do not contribute to the formation of the image have a width and a spacing complying with the ratio $r_0$.

6. The method as claimed in claim 1, wherein, for the purpose of forming an image in relief, said lines are modulated by the shape of the image and transformed to create a relief effect.

7. The method as claimed in claim 1, wherein, for the purpose of forming a geometrical image, the width of the strokes is modified along each line as a function of the gray level of the original geometrical image.

8. The method as claimed in claim 1, wherein, for the purpose of creating an artistic image, the width of the strokes is modified along each line as a function of the scanned original digital image.

9. A paper security which is furnished with at least one security design generated according to the method of claim 1.

10. A method for generating, with the aid of electronic means, a security design intended to be printed on paper securities, especially banknotes and currency papers, and composed of multiple lines, wherein the following steps are carried out:

a) a uniform background is generated, consisting of parallel straight lines such that the distance between the longitudinal mid-axes of two consecutive lines, designated as the spacing $d_0$ between two lines, is constant and such that the width $l_0$ of the line strokes is also constant, thus determining a constant ration $r_0=l_0/d_0$, b) the background is modified by modulating the spacing $d_0$ between the lines according to a periodic modulation function whose parameters are chosen beforehand, c) the width of the line strokes is modified such that the ration of the width $l_n$ of the stroke of a line to its spacing $d_n$ with the following line is equal to the constant ration $l_n/d_n=r_0$.

* * * * *